US011440040B2

(12) United States Patent
Hooker

(10) Patent No.: US 11,440,040 B2
(45) Date of Patent: Sep. 13, 2022

(54) STANDALONE PEDAL SPRAYER

(71) Applicant: Jimmy Hooker, Garland, TX (US)

(72) Inventor: Jimmy Hooker, Garland, TX (US)

( * ) Notice: Subject to any disclaimer, the term of this patent is extended or adjusted under 35 U.S.C. 154(b) by 0 days.

(21) Appl. No.: 17/334,063

(22) Filed: May 28, 2021

(65) Prior Publication Data

US 2022/0161286 A1 May 26, 2022

Related U.S. Application Data

(60) Provisional application No. 63/117,699, filed on Nov. 24, 2020.

(51) Int. Cl.

*B05B 11/00* (2006.01)
*A47K 5/12* (2006.01)
*B05B 12/00* (2018.01)

(52) U.S. Cl.

CPC ..... *B05B 11/3052* (2013.01); *A47K 5/1211* (2013.01); *B05B 12/002* (2013.01)

(58) Field of Classification Search

CPC ..... B05B 11/3052; B05B 11/3056; B05B 12/002; B05B 15/30; A47K 5/1205; A47K 5/1211

See application file for complete search history.

(56) References Cited

U.S. PATENT DOCUMENTS 1,061,099 A * 5/1913 Miller ..... A47K 5/00 222/51
1,676,851 A * 7/1928 Bloodhart ..... A47K 5/1205 222/179
1,947,086 A * 2/1934 Hillyard ..... A47K 5/1214 222/509
1,949,315 A * 2/1934 Levernier ..... A47K 5/1205 222/465.1
2,103,687 A * 12/1937 McKenney ..... A47K 5/1211 222/401
2,456,958 A * 12/1948 Kretschmer ..... G01F 11/08 222/209
3,203,597 A * 8/1965 Birch ..... A47K 5/1204 222/340

(Continued)

FOREIGN PATENT DOCUMENTS

CN 2600176 Y 1/2004
CN 208973619 U 6/2019
JP 2008229296 A 10/2008

*Primary Examiner* — Vishal Pancholi

(57) ABSTRACT

A standalone pedal sprayer is an apparatus that dispenses a solution. The apparatus serves as a free-standing dispenser that facilitates the retrieval of a solution such as hand sanitizer, alcohol, and the like. The apparatus includes a sprayer housing, a foot pump, a supply tubing, and a nozzle. The sprayer housing is vertically oriented and positions the nozzle within hands-reach of a user. The sprayer housing also serves as a reservoir for a solution and is refillable. The foot pump dispenses the solution within the sprayer housing and out of the nozzle. The apparatus further includes a pedal shield that protects a rubber cap of the foot pump from being damaged. In order to provide access into the sprayer housing for refill, the sprayer housing further includes a refill cover and a cam lock. The cam lock prevents any unauthorized solutions or materials from entering into the sprayer housing.

19 Claims, 8 Drawing Sheets

(56) References Cited

U.S. PATENT DOCUMENTS

| | | | | |
|---|---|---|---|---|
| 3,897,890 | A * | 8/1975 | Jente | B65D 83/267 222/179 |
| 6,695,227 | B1 | 2/2004 | Hayashi et al. | |
| 7,040,510 | B1 | 5/2006 | Hester | |
| 8,573,443 | B2 * | 11/2013 | Natterer | B05B 11/3052 222/173 |
| 2012/0187146 | A1 * | 7/2012 | Chopra | A61L 2/16 222/23 |
| 2018/0110556 | A1 | 4/2018 | Mulcahey et al. | |

* cited by examiner

STANDALONE PEDAL SPRAYER

The current application claims a priority to the U.S. Provisional Patent application Ser. No. 63/117,699 filed on Nov. 24, 2020.

FIELD OF THE INVENTION

The present invention generally relates to dispensing devices. More specifically, the present invention is a standalone pedal sprayer.

BACKGROUND OF THE INVENTION

Sanitizing stations are a common feature in bathrooms, schools, gyms, and a variety of other high traffic areas. More specifically, these sanitizing stations were typically positioned along entrances and exits of these high traffic areas. However, with the increasing need for better personal hygiene, sanitizing stations need to be more readily accessible throughout these high traffic areas and with the portable capability that will allow people to access and place them in greater areas of need.

The present invention is vertically oriented and is a free-standing unit that is activated by using a foot pump. The present invention requires no external power source to be activated unlike typical wall mounted, automatic hand sanitizer dispensers. More specifically, the present invention is not the same as the type of sprayer used by dentist such that the present invention is non-electric and does not require a motor. The present invention also provides a dispensing point and a trigger point that are in separate vertical locations. This arrangement allows a user to pump the foot pedal using their foot and retrieve the spray output from the dispensing point, which resides in a different location, further maintaining a clean and sanitized environment.

DETAILED DESCRIPTIONS OF THE INVENTION

Figure 1:
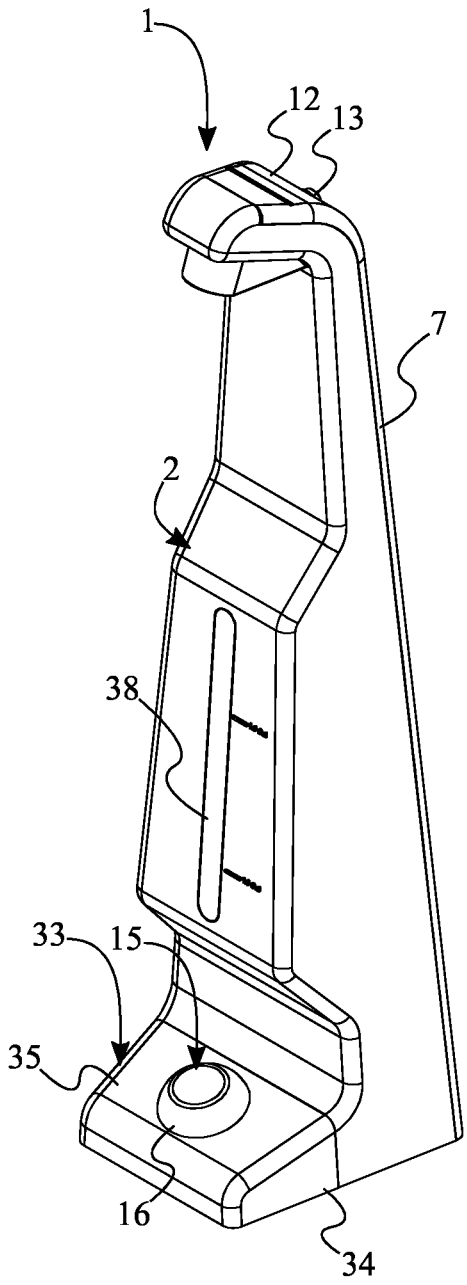
FIG. 1 is a front perspective view of the present invention.

All illustrations of the drawings are for the purpose of describing selected versions of the present invention and are not intended to limit the scope of the present invention.

The present invention is a standalone pedal sprayer that manually dispenses a solution directly into the hands of a user. The solution is preferably hand sanitizer. It is understood that various embodiments of the present invention may dispense a variety of solutions with similar viscosity. The present invention is free-standing and vertically oriented such that the present invention may be positioned anywhere and does not require a wall or the like to be mounted. Moreover, the present invention is activated by the foot of the user, further maintaining a sanitized environment.

In order for the present invention to store and dispense a solution, the present invention may comprise a sprayer housing 1, a foot pump 15, a supply tubing 31, and a nozzle 32, seen in FIG. 1, FIG. 2, FIG. 3, FIG. 4, and FIG. 6. The sprayer housing 1 stores both a quantity of solution and contains the foot pump 15, the supply tubing 31, and the nozzle 32. The quantity of solution is safely and effectively stored until dispensed by the foot pump 15 as the sprayer housing 1 may comprise a lateral portion 2, a cover plate 7, and a base plate 8. The lateral portion 2 and the cover plate 7 enclose the sprayer housing 1. The base plate 8 upholds and seals both the lateral portion 2 and the cover plate 7 so that the sprayer housing 1 is a single, free-standing unit. Furthermore, the base plate 8 stabilizes the sprayer housing 1 with the ground. More specifically, the lateral portion 2 may comprise a first opening rim 3 and a second opening rim 4. The first opening rim 3 connects the lateral portion 2 with the cover plate 7, and the second opening rim 4 connects the lateral portion 2 with the base plate 8. In the preferred embodiment of the present invention, the sprayer housing 1 is made of a plastic material. It is understood that the sprayer housing 1 may be made of a variety of rigid materials. The foot pump 15 provides the force necessary to deliver the solution from within the sprayer housing 1 out through the nozzle 32. Furthermore, the foot pump 15 activates the present invention and is preferably engaged with the foot of the user. The nozzle 32 provides a continuous and clear path for the solution to exit the sprayer housing 1. Furthermore, the nozzle 32 directly dispenses the solution into the hands of the user.

The overall configuration of the aforementioned components allows the present invention to push and dispense a solution above the foot pump 15. In order for the solution to be stored within the sprayer housing 1, the first opening rim 3 is positioned adjacent with the second opening rim 4, seen in FIG. 2 and FIG. 6. More specifically, the first opening rim 3 is positioned perpendicular with the second opening rim 4. The sprayer housing 1 is enclosed as the cover plate 7 is positioned adjacent and across the first opening rim 3. The cover plate 7 is removably attached with the first opening rim 3, in the event the supply tubing 31 or the interior of the sprayer housing 1 need to be accessed. Similarly, the base plate 8 is positioned adjacent and across the second opening rim 4. The second opening rim 4 is fixed onto the base plate 8, effectively stabilizing the present invention. The arrangement between the cover plate 7 and the base plate 8 with the lateral portion 2 defines the vertical orientation of the sprayer housing 1. In order to keep the foot pump 15 dry and protect the foot pump 15 from the quantity of solution within the sprayer housing 1, the foot pump 15 is externally positioned with the sprayer housing 1 and is positioned adjacent with the lateral portion 2, opposite the cover plate 7. The foot pump 15 is mounted onto the base plate 8, thereby facilitating access for the foot of a user. The present invention remains compact as the supply tubing 31 is positioned within the sprayer housing 1, protecting the connection between the quantity of solution and the nozzle 32. In order to deliver the solution within hands-reach of the user while the user is standing, the nozzle 32 is positioned adjacent with the lateral portion 2, opposite the base plate 8. Moreover, the nozzle 32 is integrated into the lateral portion 2 such that the nozzle 32 is secure while dispensing solution. The solution is forced upwards to the nozzle 32 from within the sprayer housing 1 as the foot pump 15 is in fluid communication with the nozzle 32 through the supply tubing 31.

In order to preserve the foot pump 15 throughout multiple uses, the present invention may further comprise a pedal shield 33, seen in FIG. 1, FIG. 2, FIG. 3, FIG. 4, and FIG. 6. The pedal shield 33 prevents the mechanism of the foot pump 15 from being damaged while engaged by the foot of a user. The pedal shield 33 may comprise a U-shaped lateral wall 34, a first base wall 35, and a cap-receiving hole 36. The U-shaped lateral wall 34 and the first base wall 35 surround the foot pump 15 beside the lateral portion 2. The cap-receiving hole 36 provides direct access for the foot of the user with the foot pump 15. The foot pump 15 is enclosed between the pedal shield 33 and the lateral portion 2 as the pedal shield 33 is positioned adjacent with the lateral portion 2, opposite the cover plate 7. The first base wall 35 is fixed adjacent with the U-shaped lateral wall 34, thereby securing the pedal shield 33 with the sprayer housing 1, and consequently the position of the foot pump 15 with the sprayer housing 1. The foot of the user is able to access and engage with the foot pump 15 while positioned underneath the pedal shield 33 as the cap-receiving hole 36 traverses through the first base wall 35. The lateral portion 2 is positioned adjacent with a wall opening 27 of the U-shaped lateral wall 34, maintaining a continuous connection between the foot pump 15 and the quantity of solution within the sprayer housing 1. The structural integrity of the foot pump 15 is preserved while engaged with the foot of the user as the foot pump 15 is positioned adjacent with the cap-receiving hole 36. A rubber cap 16 of the foot pump 15 is positioned through the cap-receiving hole 36 so that the user may activate the foot pump 15 through the pedal shield 33. More specifically, the rubber cap 16 is hermetically sealed with the first base wall 35 through the cap-receiving hole 36 so that the foot pump 15 is able to effectively force the solution through the supply tubing 31 while simultaneously being secured with the pedal shield 33.

Figure 2:
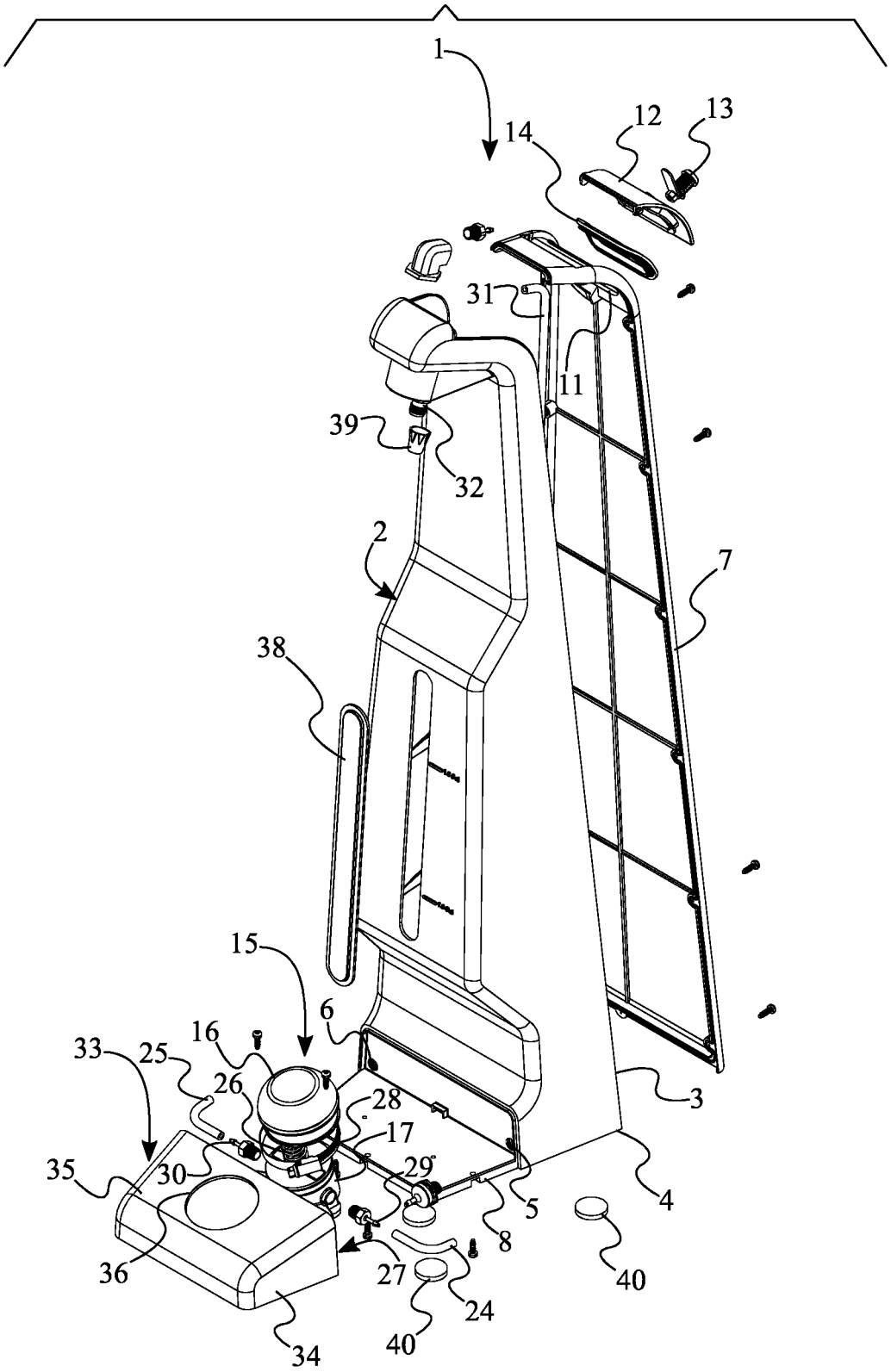
FIG. 2 is a front exploded view of the present invention.
Figure 3:
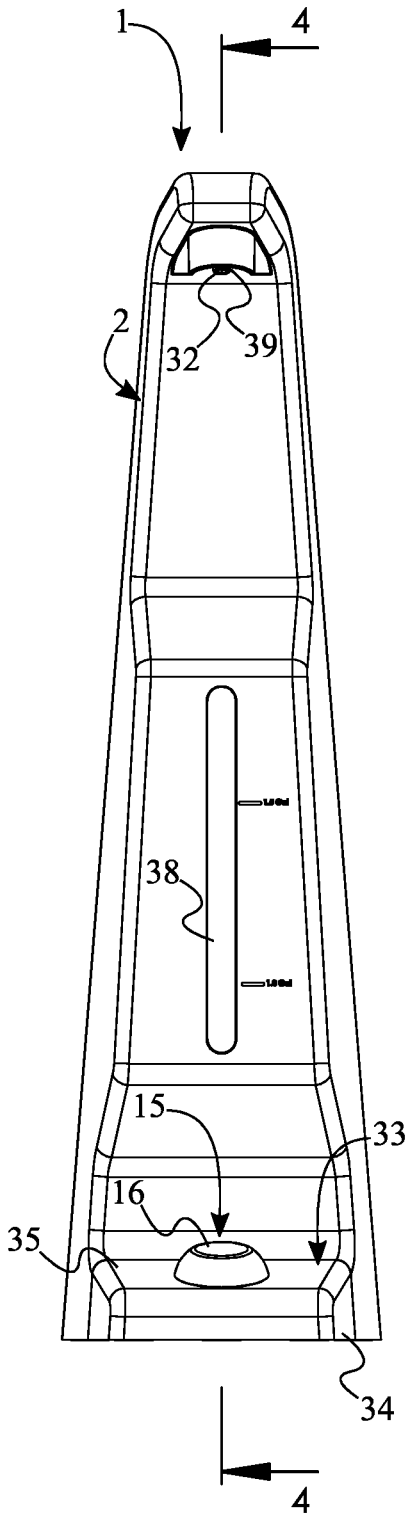
FIG. 3 is a front side view of the present invention.
Figure 4:
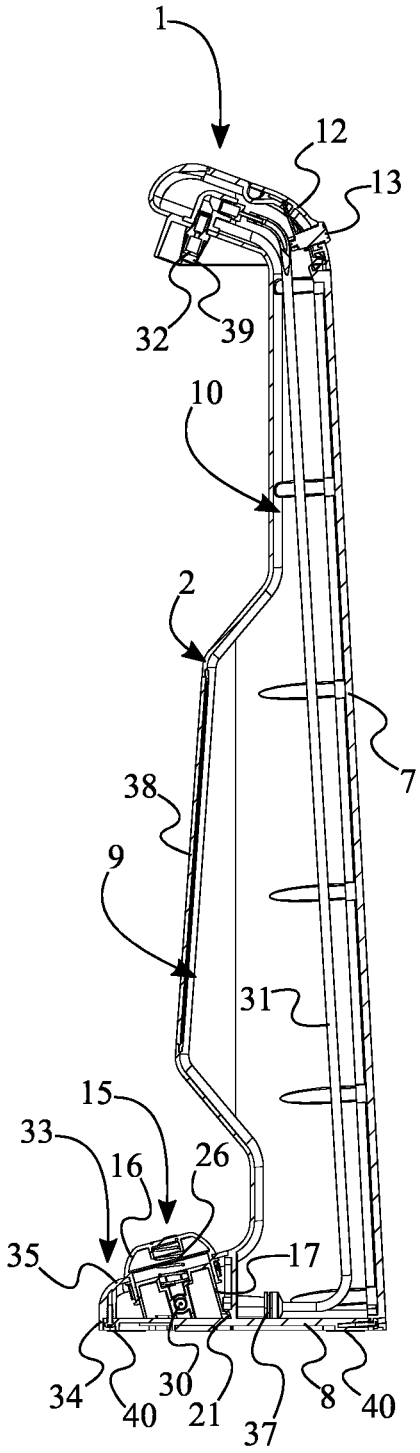
FIG. 4 is a cross-section view taken along line 4-4 in FIG. 3.
Figure 6:
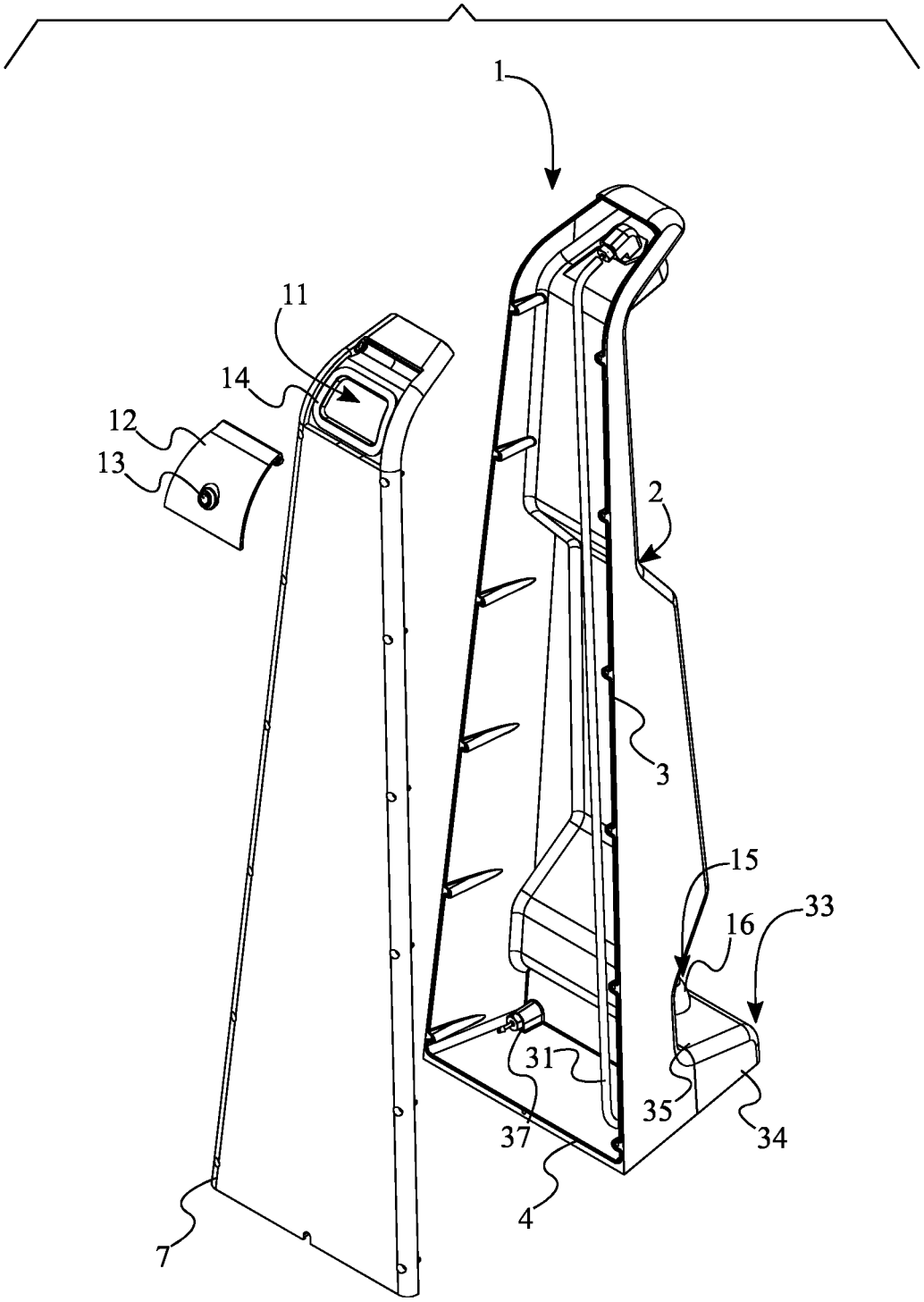
FIG. 6 is a rear perspective view of the present invention.

In order for the solution to be forced upwards through the supply tubing 31 and out of the nozzle 32 with minimal force, the present invention may further comprise a check valve 37, seen in FIG. 2, FIG. 4, and FIG. 6. As the dispensing point of the present invention is positioned above the trigger point of the present invention, the check valve 37 prevents any backflow of solution into the foot pump 15. In order to accommodate the vertical orientation of the present invention, the sprayer housing 1 may further comprise a reservoir portion 9 and a dispensing portion 10. The reservoir portion 9 houses the quantity of solution. The dispensing portion 10 upholds the nozzle 32 and offsets the nozzle 32 from the reservoir portion 9. In order to provide a continuous connection between the foot pump 15 and the supply tubing 31, the lateral portion 2 may further comprise a first hole 5 and a second hole 6, and the foot pump 15 may comprise a chamber 17, an inlet tubing 24, and an outlet tubing 25. The first hole 5 and the second hole 6 positions the inlet tubing 24 and the outlet tubing 25, respectively, through the lateral portion 2. The chamber 17 houses the mechanism of the foot pump 15. The inlet tubing 24 delivers the solution from within the sprayer housing 1 to the chamber 17, and the outlet tubing 25 pushes the solution from within the chamber 17 and through the supply tubing 31. Due to the vertical orientation of the present invention, the reservoir portion 9 is positioned adjacent with the base plate 8 such that the solution fills the sprayer housing 1 from the base plate 8 upwards. Moreover, the dispensing portion 10 is positioned adjacent with the reservoir portion 9, opposite the base plate 8, positioning the nozzle 32 within hands-reach of the user. In order for the solution to be delivered to the nozzle 32 from the reservoir portion 9 below, the supply tubing 31 traverses from the reservoir portion 9 into the dispensing portion 10. The inlet tubing 24 and the outlet tubing 25 are able to be positioned through the lateral portion 2 while preserving the structural integrity of the lateral portion 2 as the first hole 5 and the second hole 6 laterally traverse through the lateral portion 2. The inlet tubing 24 and the outlet tubing 25 are safely housed within the pedal shield 33 and require minimal length to connect the foot pump 15 with both the solution within the sprayer housing 1 and the supply tubing 31 as the first hole 5 and the second hole 6 are positioned adjacent with the foot pump 15. More specifically, the inlet tubing 24 is positioned through the first hole 5, and the outlet tubing 25 is positioned through the second hole 6. The foot pump 15 is secured as the chamber 17 is mounted onto the base plate 8. The solution within the sprayer housing 1 is forced through the chamber 17 as the inlet tubing 24 and the outlet tubing 25 are mounted into the chamber 17. More specifically, the reservoir portion 9 is in fluid communication with the chamber 17 through the inlet tubing 24. The chamber 17 is not damaged from any backflow as the chamber 17 is in fluid communication with the check valve 37 through the outlet tubing 25. A continuous flow of solution is dispensed from the nozzle 32 as the check valve 37 is in fluid communication with the nozzle 32 through the supply tubing 31.

The foot pump 15 provides the necessary force to deliver the solution upwards to the nozzle 32 through the supply tubing 31 as the foot pump 15 may further comprise a spring 26, a rubber cap 16, and an annular clamp 28, seen in FIG. 2, FIG. 4, FIG. 7, and FIG. 8. The spring 26 resets the rubber cap 16 into a neutral position after it has been pressed by the foot of a user. The rubber cap 16 serves as a button or an actuator for the foot of the user. The annular clamp 28 secures the rubber cap 16 with the chamber 17. Moreover, the chamber 17 may comprise a second lateral wall 18, a second base wall 21, an inlet channel 22, and an outlet channel 23. In order for the foot pump 15 to create pressure within the chamber 17, the second lateral wall 18 and the second base wall 21 define the chamber 17. The inlet channel 22 and the outlet channel 23 allow the inlet tubing 24 and the outlet tubing 25, respectively, to connect with the chamber 17 while preserving the structural integrity of the chamber 17. Moreover, the second lateral wall 18 may comprise a first open end 19 and a second open end 20. The first open end 19 corresponds to the rubber cap 16, and the second open end 20 corresponds to the second base wall 21. In order for the chamber 17 to serve as a piston with the rubber cap 16, the first open end 19 is positioned opposite the second open end 20 about the second lateral wall 18. More specifically, the second open end 20 is positioned adjacent with the second base wall 21. The chamber 17 is secured with the sprayer housing 1 as the second base wall 21 is positioned adjacent with the base plate 8. The second base wall 21 may be secure with fasteners such as screws or a strong adhesive. The continuous flow of solution through the chamber 17 is maintained, while preserving the structural integrity of the second lateral wall 18 as the inlet channel 22 and the outlet channel 23 laterally traverse through the second lateral wall 18. The rubber cap 16 is oriented towards the foot of the user instead of the base plate 8 of the sprayer housing 1 as the rubber cap 16 is positioned adjacent with the first open end 19. The foot pump 15 is manually activated by the foot of the user, and the pressure forces the solution into the outlet tubing 25 and into the supply tubing 31 as the rubber cap 16 is hermetically sealed around the first open end 19. The rubber cap 16 is returned to a neutral position after being pressed as the spring 26 is mounted within the rubber cap 16 and is pressed against the second base wall 21 by the rubber cap 16. This arrangement also maximizes the amount of solution that is pumped through the chamber 17 with the rubber cap 16.

Figure 7:
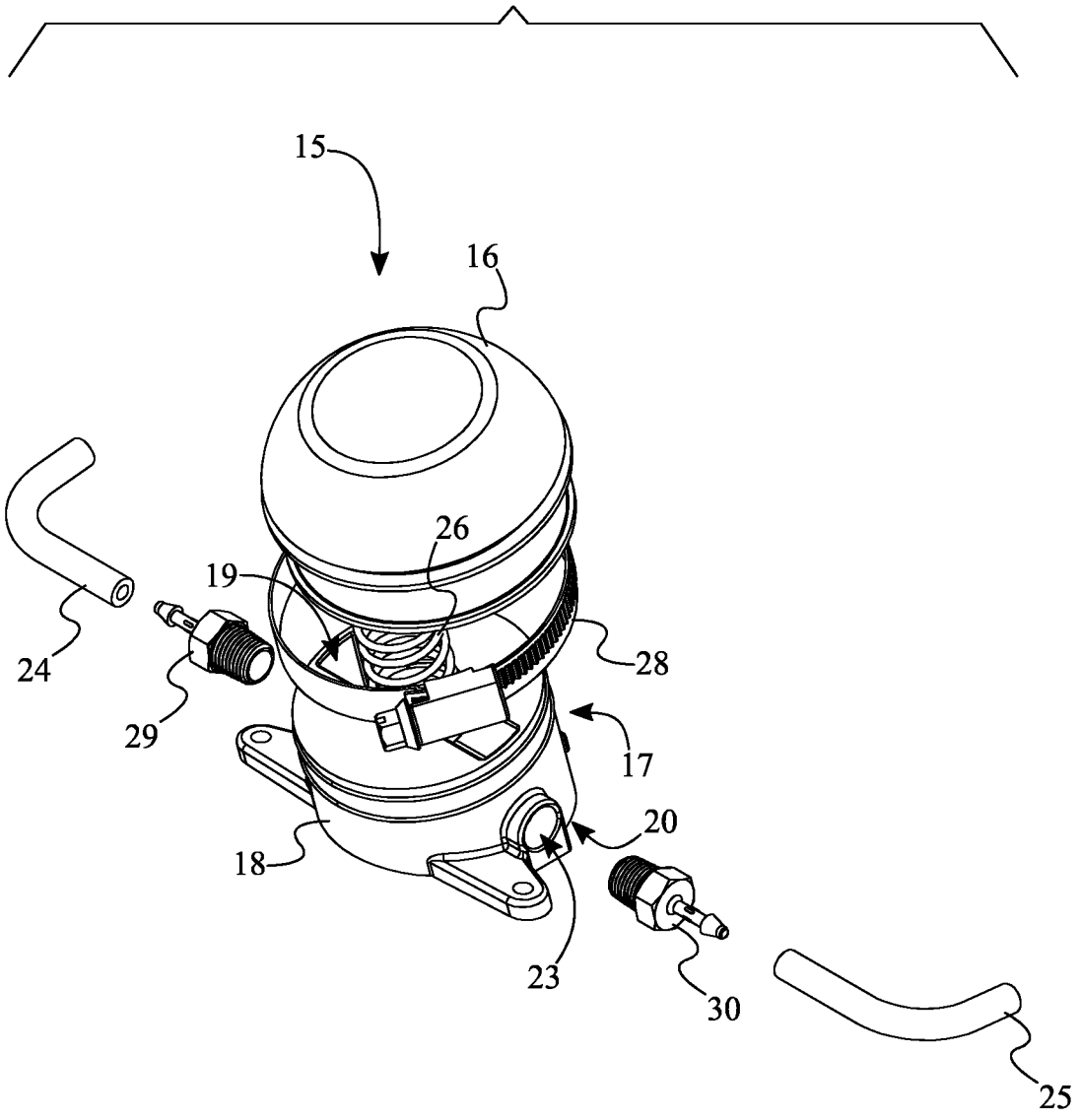
FIG. 7 is a front exploded view of a foot pump of the present invention.
Figure 8:
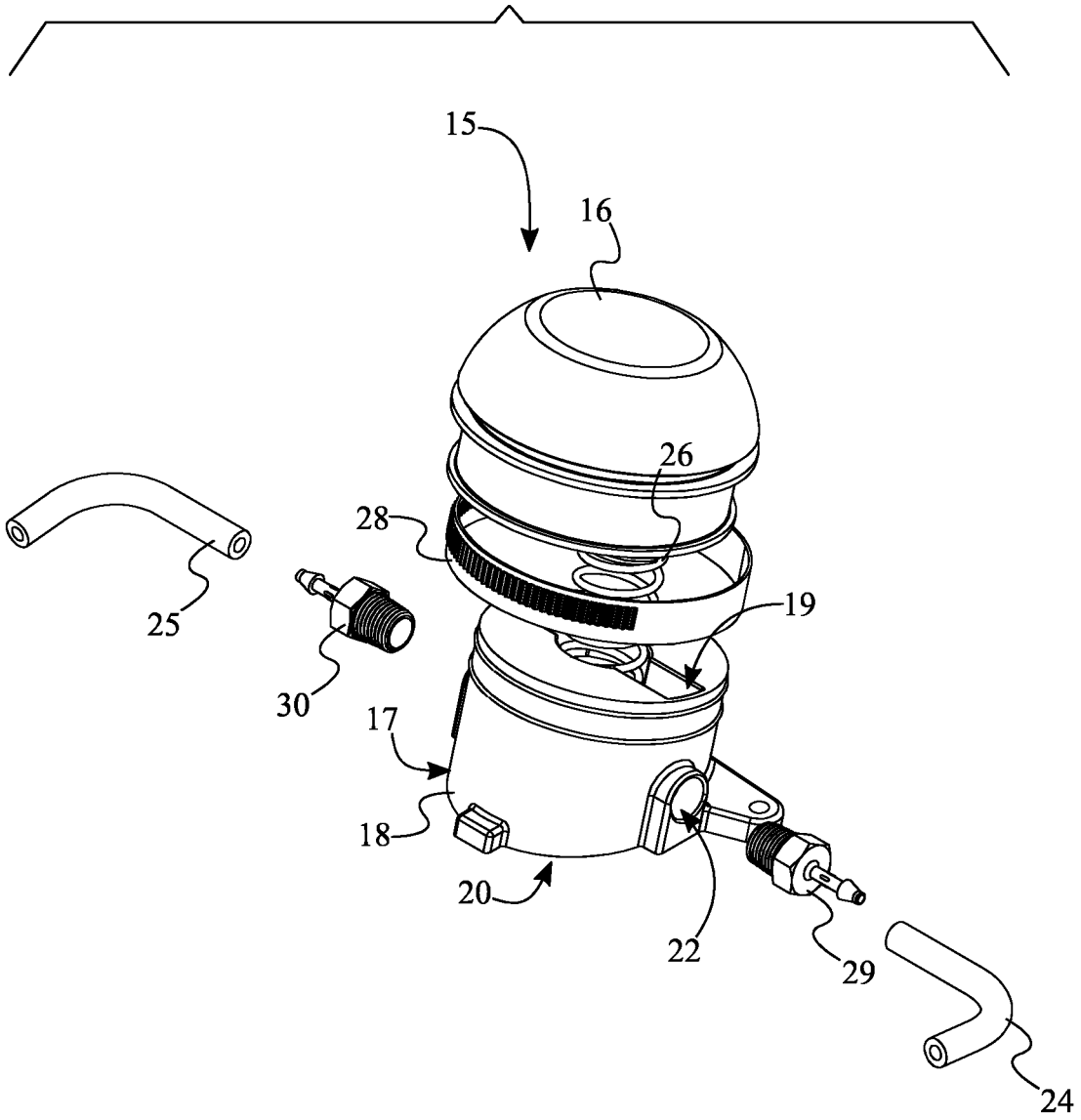
FIG. 8 is a rear exploded view of the foot pump of the present invention.

In the preferred embodiment of the present invention, the foot pump 15 further comprises a first fitting 29 and a second fitting 30. FIG. 2, FIG. 7, and FIG. 8. The first fitting 29 and the second fitting 30 reinforce the connection between the inlet tubing 24 and the outlet tubing 25 with the chamber 17 while solution is forced into and out of the foot pump 15. The solution continuously flows into the chamber 17 as the inlet tubing 24 is hermetically connected to the inlet channel 22 by the first fitting 29. Likewise, the solution continuously flows out of the outlet tubing 25 is hermetically connected to the inlet channel 22 by the second fitting 30.

The solution within the sprayer housing 1 is refillable as the sprayer housing 1 may further comprise a refill slot 11, a refill cover 12, and a cam lock 13, seen in FIG. 2 and FIG. 6. The refill slot 11 provides access into the sprayer housing 1 while preserving the structural integrity of the sprayer housing 1, specifically the cover plate 7. The refill cover 12 seals the refill slot 11 when not being accessed or used. The cam lock 13 provides security for the sprayer housing 1 so that only authorized individuals may access the refill slot 11 and only the specified solution may refill the sprayer housing 1. In order for the solution being poured into the refill slot 11 to be directed directly towards the reservoir portion 9, the refill slot 11 traverses through the cover plate 7 and is positioned adjacent to the nozzle 32. The sprayer housing 1 is fully enclosed after the refill is complete as the refill cover 12 is positioned adjacent and across the refill slot 11. The refill cover 12 is operatively coupled with the cover plate 7 by the cam lock 13, wherein the cam lock 13 is used to selectively lock the refill cover 12 into the refill slot 11 and is used to selectively lock the refill cover 12 into the refill slot 11. This engagement effectively prevents any contamination of solution within the sprayer unit during refills and throughout use of the present invention.

In the preferred embodiment of the present invention, the sprayer housing 1 further comprises a gasket 14, also seen in FIG. 2 and FIG. 6. The gasket 14 seals the solution within the sprayer housing 1 such that the solution does not evaporate through the refill slot 11. Moreover, the solution does not spill through the refill slot 11. In order to effectively seal the solution within the sprayer housing 1, the gasket 14 is externally positioned with the sprayer housing 1 and is positioned in between the cover plate 7 and the refill cover 12. The gasket 14 is perimetrically fixed around the refill slot 11, thereby maintaining access into the sprayer housing 1 through the refill slot 11.

In order to determine when the sprayer housing 1 needs to be refilled, the present invention may further comprise a level window 38, seen in FIG. 1, FIG. 2, FIG. 3, and FIG. 4. The level window 38 provides a view within the sprayer housing 1, specifically the reservoir portion 9, from outside of the sprayer housing 1. The level window 38 serves as a visual aid for a user to see if the quantity of solution needs to be refilled or if anything within the reservoir portion 9 of the sprayer housing 1 needs to be repaired. In order to easily and quickly view the solution within the sprayer housing 1, the level window 38 is laterally integrated along with the lateral portion 2, opposite the cover plate 7. This arrangement positions the level window 38 directly underneath the nozzle 32 so that the user may be able to view the level of solution within the sprayer housing 1 with each use. More specifically, the level window 38 is positioned offset from the base plate 8 so that the level of the solution within the sprayer housing 1 is better monitored and the user is visually notified of lowering solution levels before the sprayer housing 1 is empty.

The preferred embodiment of the present invention further comprises a nozzle cap 39. The nozzle cap 39 accurately directs the solution dispensed from the nozzle 32, seen in FIG. 2, FIG. 3, and FIG. 4. More specifically, the nozzle cap 39 ensures that the solution that is dispensed from the nozzle 32 does not spray everywhere, but directly onto the hands of a user. In order to contain and direct the dispensed solution, the nozzle cap 39 is externally positioned with the sprayer housing 1 and is mounted onto the lateral portion 2. More specifically, the nozzle 32 is positioned into the nozzle cap 39.

Figure 5:
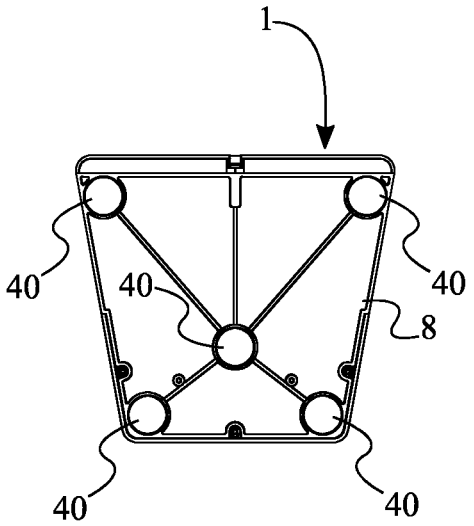
FIG. 5 is a bottom side view of the present invention.

The preferred embodiment of the present invention further comprises a plurality of friction-inducing pads 40, seen in FIG. 2 and FIG. 5. The plurality of friction-inducing pads 40 reinforces the desired position of the present invention across a floor or the ground. In order to come into contact with the floor or the ground, the plurality of friction-inducing pads 40 is positioned adjacent with the base plate 8, opposite the lateral portion 2. The base plate 8 is evenly secured with the floor or the ground as the plurality of friction-inducing pads 40 is distributed across the base plate 8 and is fixed onto the base plate 8.

Although the invention has been explained in relation to its preferred embodiment, it is to be understood that many other possible modifications and variations can be made without departing from the spirit and scope of the invention as hereinafter claimed.

What is claimed is:

1. A standalone pedal sprayer comprises:

a sprayer housing;

a foot pump;

a supply tubing;

a nozzle;

the sprayer housing comprises a lateral portion, a cover plate, and a base plate;

the lateral portion comprises a first opening rim and a second opening rim;

the first opening rim being positioned adjacent with the second opening rim;

the first opening rim being positioned perpendicular with the second opening rim;

the cover plate being positioned adjacent and across the first opening rim;

the cover plate being removably attached with the first opening rim;

the base plate being positioned adjacent and across the second opening rim;

the second opening rim being fixed onto the base plate;

the foot pump being externally positioned with the sprayer housing;

the foot pump being positioned adjacent with the lateral portion, opposite the cover plate;

the foot pump being mounted onto the base plate;

the supply tubing being positioned within the sprayer housing;

the nozzle being positioned adjacent with the lateral portion, opposite the base plate;

the nozzle being integrated into the lateral portion; and, the foot pump being in fluid communication with the nozzle through the supply tubing.

2. The standalone pedal sprayer as claimed in claim 1 comprises:

a pedal shield;

the pedal shield comprises a U-shaped lateral wall, a first base wall, and a cap-receiving hole;

the pedal shield being positioned adjacent with the lateral portion, opposite the cover plate;

the first base wall being fixed adjacent with the U-shaped lateral wall;

the cap-receiving hole traversing through the first base wall;

the lateral portion being positioned adjacent with a wall opening of the U-shaped lateral wall;

the foot pump being positioned adjacent with the cap-receiving hole;

a rubber cap of the foot pump being positioned through the cap-receiving hole; and, the rubber cap being hermetically sealed with the first base wall through the cap-receiving hole.

3. The standalone pedal sprayer as claimed in claim 1 comprises:

a check valve;

the sprayer housing further comprises a reservoir portion and a dispensing portion;

the lateral portion further comprises a first hole and a second hole;

the foot pump comprises a chamber, an inlet tubing, and an outlet tubing;

the reservoir portion being positioned adjacent with the base plate;

the dispensing portion being positioned adjacent with the reservoir portion, opposite the base plate;

the supply tubing traversing from the reservoir portion into the dispensing portion;

the first hole and the second hole laterally traversing through the lateral portion;

the first hole and the second hole being positioned adjacent with the foot pump;

the inlet tubing being positioned through the first hole;

the outlet tubing being positioned through the second hole;

the chamber being mounted onto the base plate;

the inlet tubing and the outlet tubing being mounted into the chamber;

the reservoir portion being in fluid communication with the chamber through the inlet tubing;

the chamber being in fluid communication with the check valve through the outlet tubing; and, the check valve being in fluid communication with the nozzle through the supply tubing.

4. The standalone pedal sprayer as claimed in claim 3 comprises:

the foot pump further comprises a spring, a rubber cap, and an annular clamp;

the chamber comprises a second lateral wall, a second base wall, an inlet channel, and an outlet channel;

the second lateral wall comprises a first open end and a second open end;

the first open end being positioned opposite the second open end about the second lateral wall;

the second open end being positioned adjacent with the second base wall;

the second base wall being positioned adjacent with the base plate;

the inlet channel and the outlet channel laterally traversing through the second lateral wall;

the rubber cap being positioned adjacent with the first open end;

the rubber cap being hermetically sealed around the first open end;

the spring being mounted within the rubber cap; and, the spring being pressed against the second base wall by the rubber cap.

5. The standalone pedal sprayer as claimed in claim 4 comprises:

the foot pump further comprises a first fitting and a second fitting;

the inlet tubing being hermetically connected to the inlet channel by the first fitting; and, the outlet tubing being hermetically connected to the inlet channel by the second fitting.

6. The standalone pedal sprayer as claimed in claim 1 comprises:

the sprayer housing further comprises a refill slot, a refill cover, and a cam lock;

the refill slot traversing through the cover plate;

the refill slot being positioned adjacent to the nozzle;

the refill cover being positioned adjacent and across with the refill slot; and, the refill cover being operatively coupled with the cover plate by the cam lock, wherein the cam lock is used to selectively lock the refill cover into the refill slot and is used to selectively lock the refill cover into the refill slot.

7. The standalone pedal sprayer as claimed in claim 6 comprises:

the sprayer housing further comprises a gasket;

the gasket being externally positioned with the sprayer housing;

the gasket being positioned in between the cover plate and the refill cover; and, the gasket being perimetrically fixed around the refill slot.

8. The standalone pedal sprayer as claimed in claim 1 comprises:

a level window;

the level window being laterally integrated along with the lateral portion, opposite the cover plate; and, the level window being positioned offset from the base plate.

9. The standalone pedal sprayer as claimed in claim 1 comprises:

a nozzle cap;

the nozzle cap being externally positioned with the sprayer housing;

the nozzle cap being mounted onto the lateral portion; and, the nozzle being positioned into the nozzle cap.

10. The standalone pedal sprayer as claimed in claim 1 comprises:

a plurality of friction-inducing pads;

the plurality of friction-inducing pads being positioned adjacent with the base plate, opposite the lateral portion;

the plurality of friction-inducing pads being distributed across the base plate; and, the plurality of friction-inducing pads being fixed onto the base plate.

11. A standalone pedal sprayer comprises:

a sprayer housing;

a foot pump;

a supply tubing;

a nozzle;

a level window;

the sprayer housing comprises a lateral portion, a cover plate, and a base plate;

the lateral portion comprises a first opening rim and a second opening rim;

the first opening rim being positioned adjacent with the second opening rim;

the first opening rim being positioned perpendicular with the second opening rim;

the cover plate being positioned adjacent and across the first opening rim;

the cover plate being removably attached with the first opening rim;

the base plate being positioned adjacent and across the second opening rim;

the second opening rim being fixed onto the base plate;

the foot pump being externally positioned with the sprayer housing;

the foot pump being positioned adjacent with the lateral portion, opposite the cover plate;

the foot pump being mounted onto the base plate;

the supply tubing being positioned within the sprayer housing;

the nozzle being positioned adjacent with the lateral portion, opposite the base plate;

the nozzle being integrated into the lateral portion;

the foot pump being in fluid communication with the nozzle through the supply tubing;

the level window being laterally integrated along with the lateral portion, opposite the cover plate; and, the level window being positioned offset from the base plate.

12. The standalone pedal sprayer as claimed in claim 11 comprises:

a pedal shield;

the pedal shield comprises a U-shaped lateral wall, a first base wall, and a cap-receiving hole;

the pedal shield being positioned adjacent with the lateral portion, opposite the cover plate;

the first base wall being fixed adjacent with the U-shaped lateral wall;

the cap-receiving hole traversing through the first base wall;

the lateral portion being positioned adjacent with a wall opening of the U-shaped lateral wall;

the foot pump being positioned adjacent with the cap-receiving hole;

a rubber cap of the foot pump being positioned through the cap-receiving hole; and, the rubber cap being hermetically sealed with the first base wall through the cap-receiving hole.

13. The standalone pedal sprayer as claimed in claim 11 comprises:

a check valve;

the sprayer housing further comprises a reservoir portion and a dispensing portion;

the lateral portion further comprises a first hole and a second hole;

the foot pump comprises a chamber, an inlet tubing, and an outlet tubing;

the reservoir portion being positioned adjacent with the base plate;

the dispensing portion being positioned adjacent with the reservoir portion, opposite the base plate;

the supply tubing traversing from the reservoir portion into the dispensing portion;

the first hole and the second hole laterally traversing through the lateral portion;

the first hole and the second hole being positioned adjacent with the foot pump;

the inlet tubing being positioned through the first hole;

the outlet tubing being positioned through the second hole;

the chamber being mounted onto the base plate;

the inlet tubing and the outlet tubing being mounted into the chamber;

the reservoir portion being in fluid communication with the chamber through the inlet tubing;

the chamber being in fluid communication with the check valve through the outlet tubing; and, the check valve being in fluid communication with the nozzle through the supply tubing.

14. The standalone pedal sprayer as claimed in claim 13 comprises:

the foot pump further comprises a spring, a rubber cap, and an annular clamp;

the chamber comprises a second lateral wall, a second base wall, an inlet channel, and an outlet channel;

the second lateral wall comprises a first open end and a second open end;

the first open end being positioned opposite the second open end about the second lateral wall;

the second open end being positioned adjacent with the second base wall;

the second base wall being positioned adjacent with the base plate;

the inlet channel and the outlet channel laterally traversing through the second lateral wall;

the rubber cap being positioned adjacent with the first open end;

the rubber cap being hermetically sealed around the first open end;

the spring being mounted within the rubber cap; and, the spring being pressed against the second base wall by the rubber cap.

15. The standalone pedal sprayer as claimed in claim 14 comprises:

the foot pump further comprises a first fitting and a second fitting;

the inlet tubing being hermetically connected to the inlet channel by the first fitting; and, the outlet tubing being hermetically connected to the inlet channel by the second fitting.

16. The standalone pedal sprayer as claimed in claim 11 comprises:

the sprayer housing further comprises a refill slot, a refill cover, and a cam lock;

the refill slot traversing through the cover plate;

the refill slot being positioned adjacent to the nozzle;

the refill cover being positioned adjacent and across with the refill slot; and, the refill cover being operatively coupled with the cover plate by the cam lock, wherein the cam lock is used to selectively lock the refill cover into the refill slot and is used to selectively lock the refill cover into the refill slot.

17. The standalone pedal sprayer as claimed in claim 16 comprises:

the sprayer housing further comprises a gasket;

the gasket being externally positioned with the sprayer housing;

the gasket being positioned in between the cover plate and the refill cover; and, the gasket being perimetrically fixed around the refill slot.

18. The standalone pedal sprayer as claimed in claim 11 comprises:

a nozzle cap;

the nozzle cap being externally positioned with the sprayer housing;

the nozzle cap being mounted onto the lateral portion; and, the nozzle being positioned into the nozzle cap.

19. The standalone pedal sprayer as claimed in claim 11 comprises:

a plurality of friction-inducing pads;

the plurality of friction-inducing pads being positioned adjacent with the base plate, opposite the lateral portion;

the plurality of friction-inducing pads being distributed across the base plate; and, the plurality of friction-inducing pads being fixed onto the base plate.

* * * * *